US007621853B2

(12) United States Patent
LaTour

(10) Patent No.: US 7,621,853 B2
(45) Date of Patent: Nov. 24, 2009

(54) ROPELESS JUMP ROPE

(76) Inventor: Brad LaTour, 17 Thompson St., Annapolis, MD (US) 21401

( * ) Notice: Subject to any disclaimer, the term of this patent is extended or adjusted under 35 U.S.C. 154(b) by 363 days.

(21) Appl. No.: 11/002,351

(22) Filed: Dec. 2, 2004

(65) Prior Publication Data

US 2005/0288158 A1 Dec. 29, 2005

Related U.S. Application Data

(60) Provisional application No. 60/582,173, filed on Jun. 24, 2004.

(51) Int. Cl.
*A63B 21/00* (2006.01)

(52) U.S. Cl. ..... 482/81; 482/82

(58) Field of Classification Search ..... 601/107, 601/108, 111–113; 482/81–82, 91, 110
See application file for complete search history.

(56) References Cited

U.S. PATENT DOCUMENTS

| | | | | |
|---|---|---|---|---|
| 3,212,777 | A | 10/1965 | Spoczynski | |
| 3,672,093 | A * | 6/1972 | Meek, Sr. | 446/266 |
| 4,101,123 | A | 7/1978 | Anthony | |
| 4,179,119 | A | 12/1979 | Wolf | |
| 4,593,899 | A | 6/1986 | Miller | |
| 4,801,137 | A * | 1/1989 | Douglass | 482/82 |
| 5,058,883 | A | 10/1991 | Dybvik | |
| 5,643,149 | A | 7/1997 | Grimaldi | |
| 5,662,561 | A | 9/1997 | McNamara | |
| 5,697,871 | A | 12/1997 | Landfair | |
| 5,749,812 | A | 5/1998 | Feciura et al. | |
| 5,842,766 | A | 12/1998 | Scharf, III | |
| 5,895,341 | A * | 4/1999 | Jones | 482/81 |
| 6,406,407 | B1 | 6/2002 | Wiedmann et al. | |
| 6,409,636 | B1 * | 6/2002 | Risso et al. | 482/82 |
| D470,902 | S | 2/2003 | Davies | |
| 6,530,866 | B2 * | 3/2003 | Lo et al. | 482/54 |
| 6,544,148 | B1 | 4/2003 | Loew | |
| D477,853 | S | 7/2003 | Davies | |
| 6,595,900 | B1 | 7/2003 | Cook | |
| 6,624,994 | B1 | 9/2003 | Schmoock et al. | |
| 6,641,508 | B1 | 11/2003 | Ignatovich | |
| 6,645,123 | B1 | 11/2003 | Davis | |
| 6,736,763 | B1 | 5/2004 | Hsu | |
| 6,752,746 | B1 | 6/2004 | Winkler et al. | |
| D499,013 | S | 11/2004 | Kessler | |
| D499,153 | S | 11/2004 | Kuo | |
| 7,037,243 | B1 | 5/2006 | Clancy | |

FOREIGN PATENT DOCUMENTS

| | | |
|---|---|---|
| CN | 2356706 Y | 1/2000 |
| CN | 2467122 Y | 12/2001 |

* cited by examiner

*Primary Examiner*—Jerome Donnelly
(74) *Attorney, Agent, or Firm*—24IP Law Group; Timothy R. DeWitt

(57) ABSTRACT

A ropeless jump rope for simulating the jumping of rope and for calculating, recording, and displaying a variety of data relating to the use of the ropeless jump rope. A preferred embodiment comprises a housing having a grip on at least a portion thereof and a display/control portion. The display/control portion houses a microprocessor, a display/control panel and a battery compartment. The housing further houses a pulse rate monitor for monitoring the pulse of a user.

19 Claims, 10 Drawing Sheets

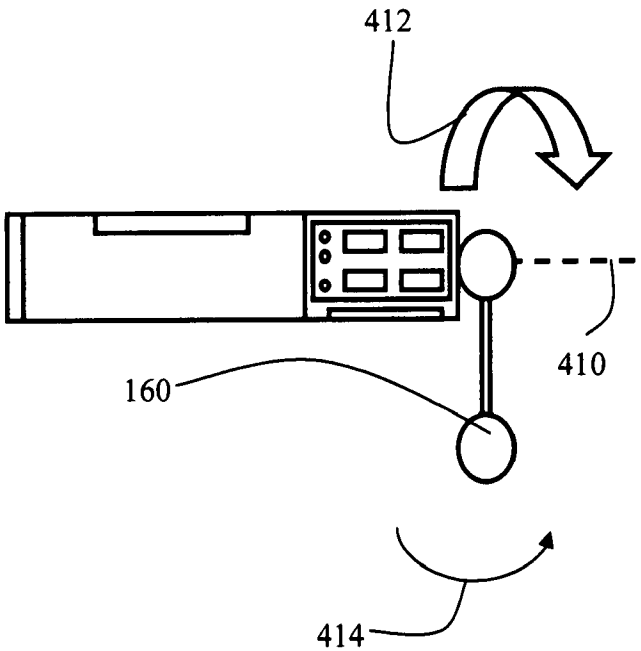
FIG. 4
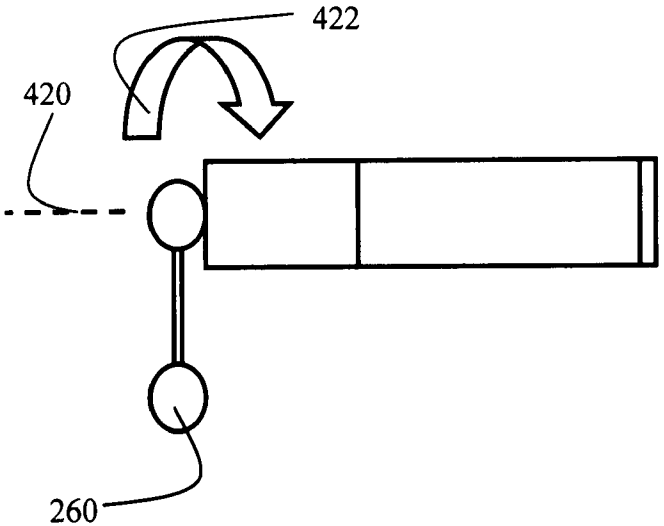

ROPELESS JUMP ROPE

CROSS-REFERENCE TO RELATED APPLICATIONS

This application claims the benefit of the filing date of U.S. Provisional Application Ser. No. 60/582,173 entitled "Jump snap—ropeless jump rope," and filed on Jun. 24, 2004 by inventor Brad LaTour, which is hereby incorporated by reference herein in its entirety.

STATEMENT REGARDING FEDERALLY SPONSORED RESEARCH OR DEVELOPMENT

Not applicable.

BACKGROUND OF THE INVENTION

1. Field of the Invention

The present invention relates to jump rope simulators and, more particularly, to a new jump rope simulator for providing a physical workout by simulating the jumping of rope while monitoring and displaying a user's pulse.

2. Description of the Related Art

A variety of conventional jump rope simulators are known. One example of such a prior art jump rope is disclosed in U.S. Pat. No. 5,895,341, which discloses a pair of hand-held units, each unit having a handle with an elongate flexible cord attached thereto. The flexible cord has a distribution of weight biased away from the handle to facilitate a twirling motion. The flexible cord on each handle may be twirled about an axis extending form the handle. The handle may have a counter with a reset button and a calorie counting device for displaying a number of calories consumed or burned. Like the counter, the calorie counter preferably has a reset button. Other examples of such known jump rope simulators include U.S. Pat. Nos. 5,662,561, D477,853, D470,902, D352,236, 5,697,871, 4,593,899, 4,179,119, 4,101,123, 6,544,148, 3,212,777 and 5,643,149.

While these prior devices may have been useful, they failed to provide the user with any ability to customize the workout in terms of the weight of the devices and the data displayed. The prior art devices failed to provide data regarding the user's workout beyond the number of turns of the handle and the calories burned. Further, the prior art devices failed to provide user's with a convenient display of such data and convenient controls for customizing the displayed data beyond simply resetting the turn and calorie counters to zero. The entirety of each of the aforementioned documents is incorporated by reference herein.

SUMMARY OF THE INVENTION

The present invention disclosed and claimed herein is a ropeless jump rope having primary and secondary handles each capable of receiving weights to adjust the intensity of the workout. Both the primary and secondary handles have weighted cords or rods attached at one end that can be swung in a rotational manner around an axis extending form the center of the handle. The primary handle has a variety of means for electronic collection of data, including a sensor or sensors for monitoring a user's heart rate and a turn counter. The primary handle also may have a receiver for receiving data, such heart rate data, from a separate device such as a chest strap from a conventional heart rate monitor. The various means for electronic collection of data output the data to a microprocessor, which stores the data and may perform various processing on the data. The primary handle further has a battery compartment for receiving batteries to power the device. A microprocessor in the primary handle receives various data regarding the workout and inputs from the user, makes various calculations, and displays requested data and results on one or more displays. The user may control the device or enter various input data through a control panel having various input means such as on/off or reset controls, scroll buttons or the like. The one or more displays can display a variety of data such as turn count, turn rate, current pulse, average pulse, average turn rate, estimated total calories burned, estimated caloric burn rate, selected pulse range, workout time, remaining workout time and the like.

Still other aspects, features, and advantages of the present invention are readily apparent from the following detailed description, simply by illustrating preferable embodiments and implementations. The present invention is also capable of other and different embodiments, and its several details can be modified in various respects, all without departing from the spirit and scope of the present invention. Accordingly, the drawings and descriptions are to be regarded as illustration in nature, and not as restrictive.

BRIEF DESCRIPTION OF THE DRAWINGS

The accompanying drawings, which are incorporated in and constitute a part of this specification illustrate some embodiments of the invention and, together with the description, serve to explain some aspects, advantages, and principles of the invention. In the drawings.

FIG. 4 illustrates the use of the invention in accordance with a preferred embodiment.

DETAILED DESCRIPTION OF THE INVENTION

Figure 1:
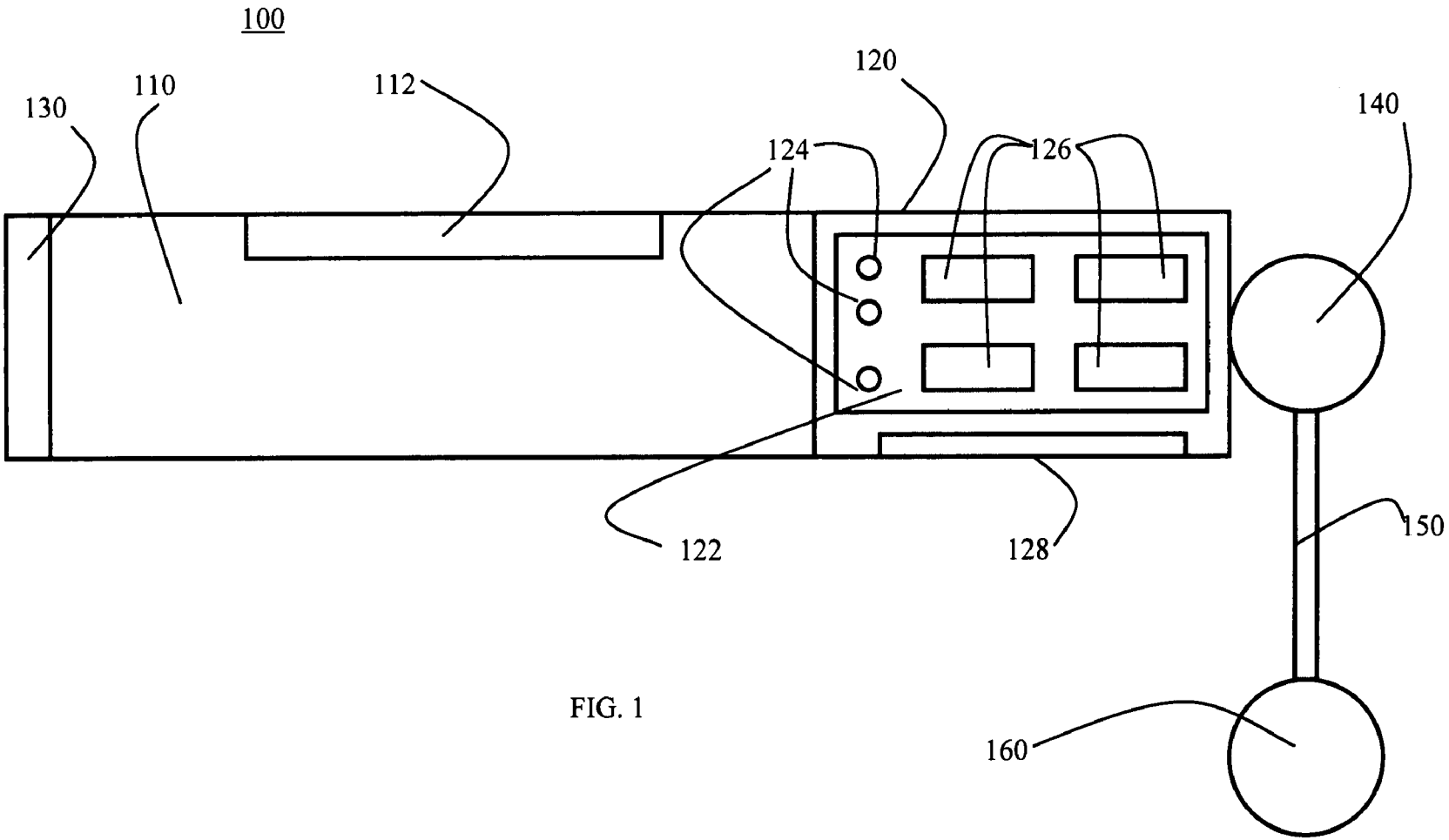
FIG. 1 illustrates a primary unit in accordance with a preferred embodiment of the present invention.
Figure 2:
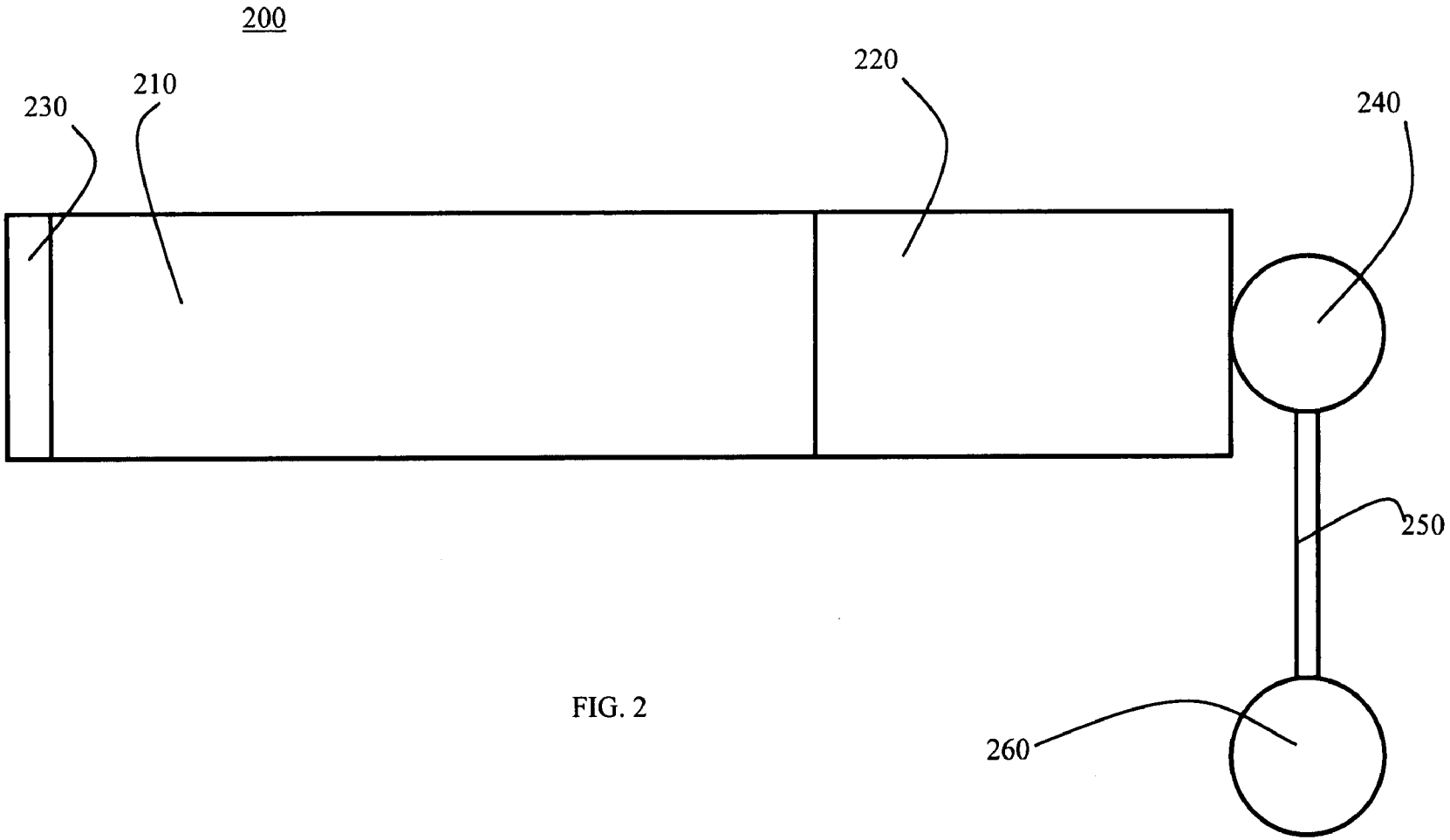
FIG. 2 illustrates a secondary unit in accordance with a preferred embodiment of the present invention.
Figure 3A:
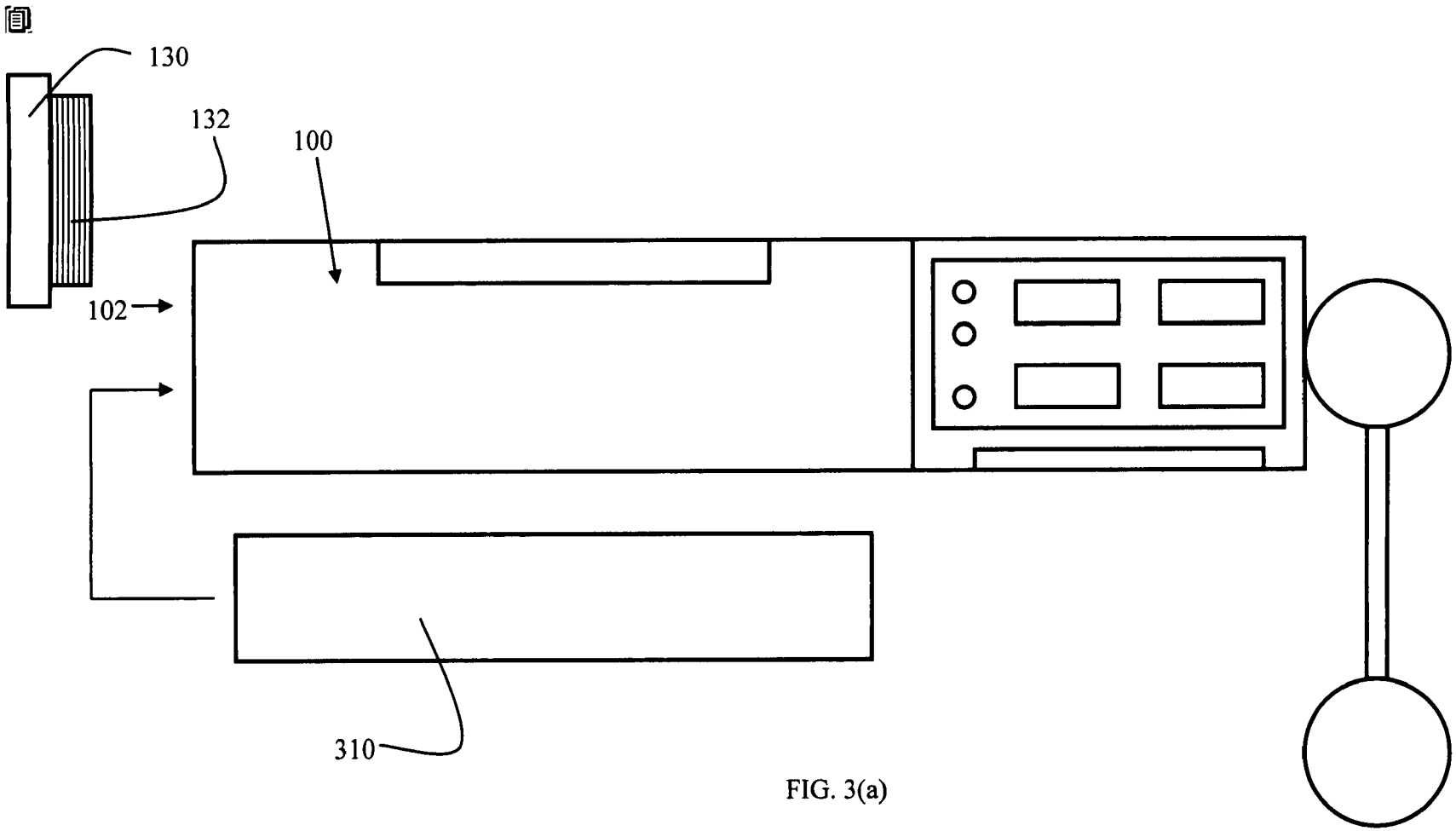
FIGS. 3(*a*) and (*b*) illustrate the use of weights in accordance with a preferred embodiment of the present invention.
Figure 3B:
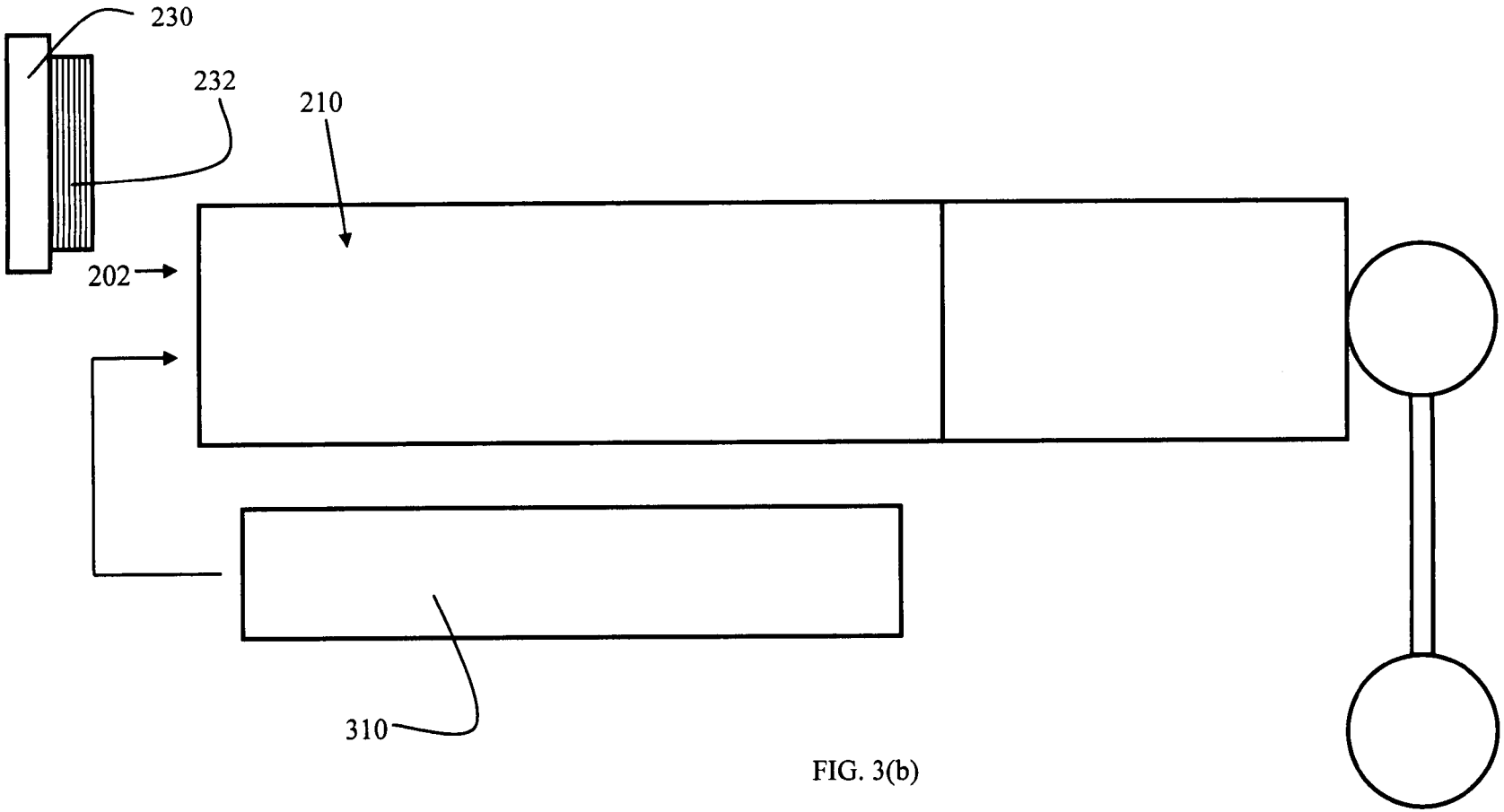

The present invention presents a novel combination of elements that collectively produce a jump rope simulator having multiple functions and adjustments that facilitate exercise. Referring to FIGS. 1, 2, 3(*a*) and 3(*b*), a preferred embodiment of the invention has two handles, one referred to as a "primary" or "smart" handle and the other referred to as a "secondary" or "dumb" handle.

A side view of primary handle of a preferred embodiment is shown in FIG. 1. The primary handle of a preferred embodiment has a housing 110 that preferably is elongate, hollow and generally cylindrical in shape. The housing 120 may be formed in other shapes provided that the housing may be gripped by a hand. Further, at one end, the housing has an opening 102 for receiving a weight 310. The inner surface of housing 110 adjacent the opening 102 is threaded for mating with a threaded portion 132 of an end cap or plug 132. The end cap 132 may be formed of any suitable material such as metal, plastic or rubber. The housing may be formed of any suitable material, such as metal, plastic or wood, but preferably is a rigid material. The housing preferable is approximately eight inches in length and has a diameter in a range suitable to be gripped by any of a variety of sizes of hands after a foam or rubber grip 114 is place on the handle. In an alternative embodiment, the handle grip may be integral with the housing such as with the housing and grip both being formed from molded plastic.

Figure 7:
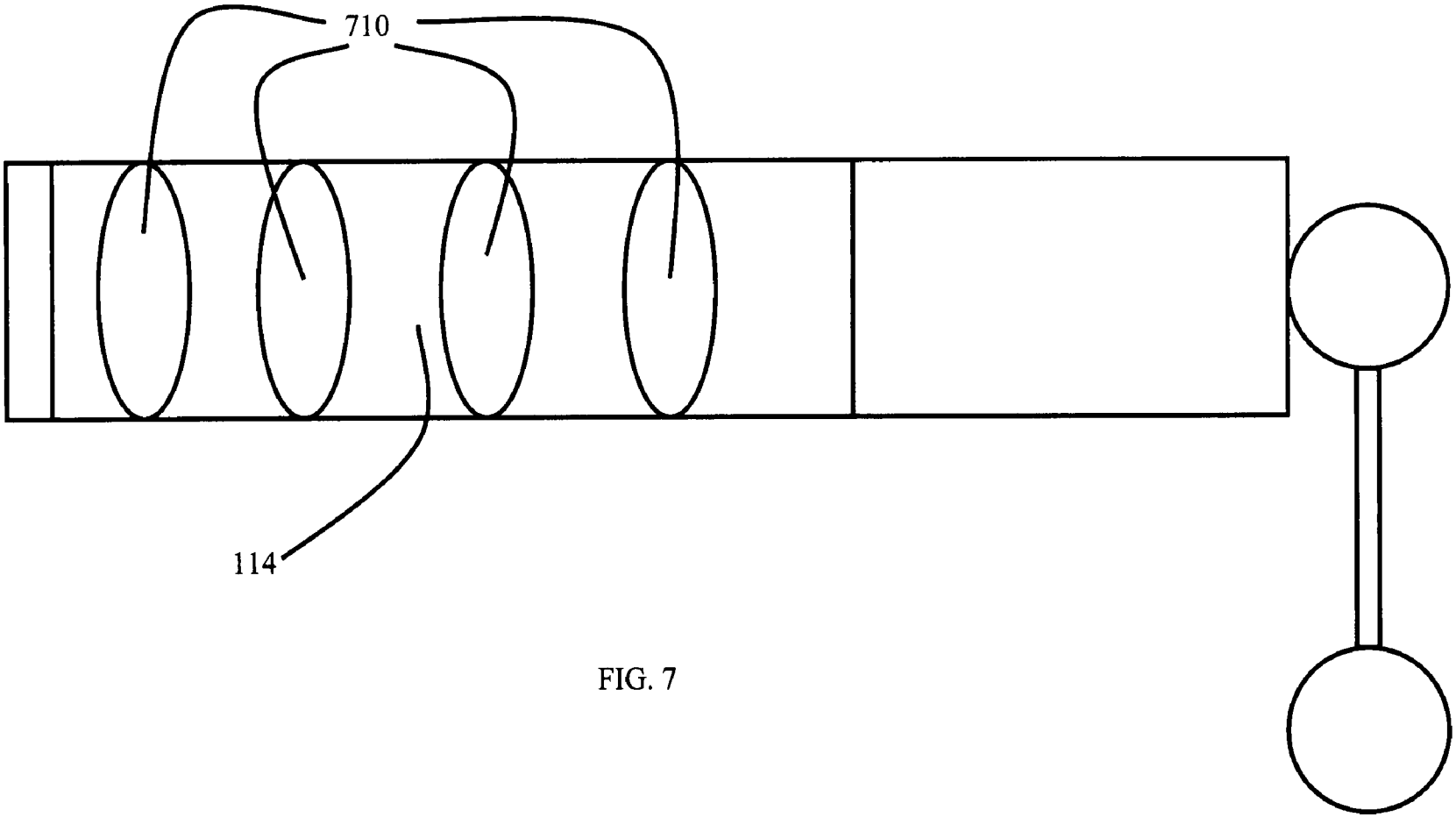
FIG. 7 illustrates finger grips in accordance with a preferred embodiment of the invention.
Figure 8:
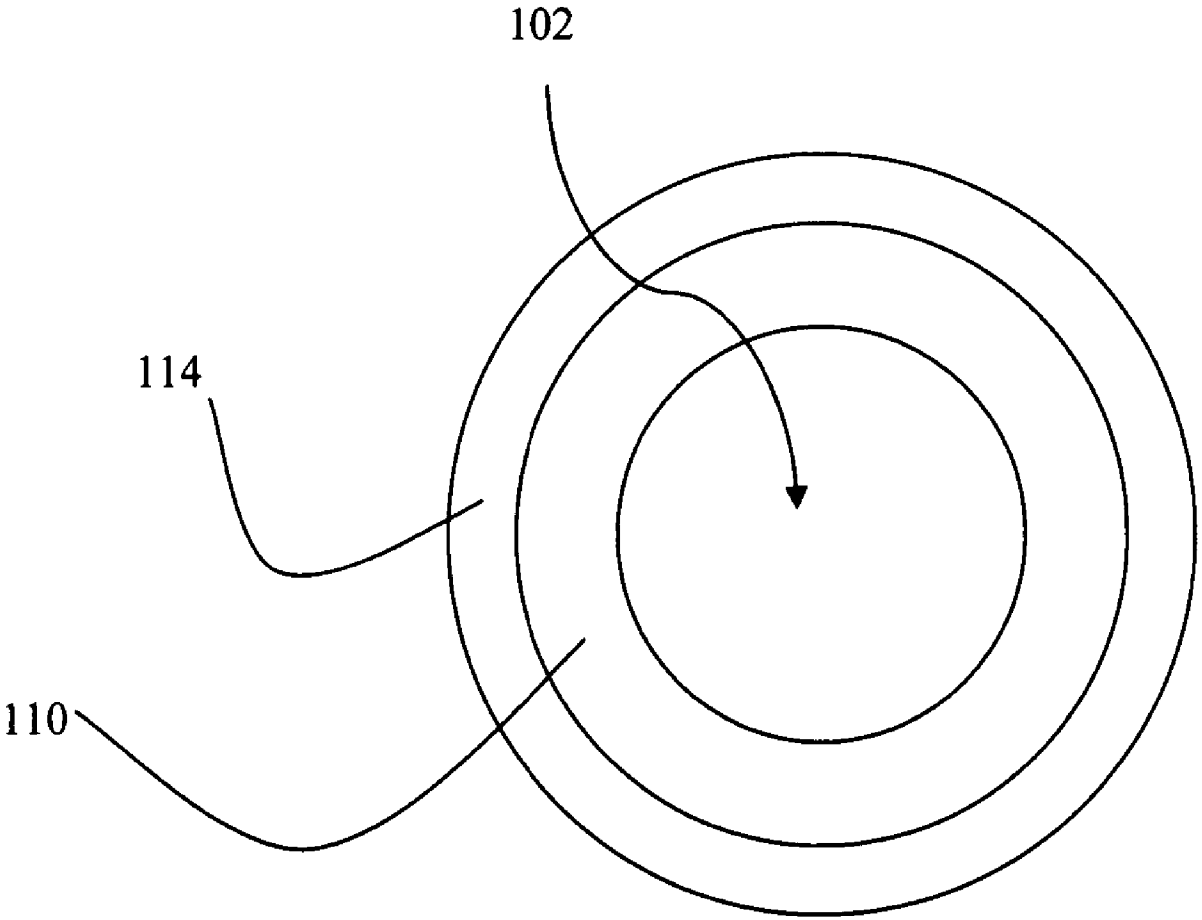
FIG. 8 illustrates and end view of a preferred embodiment of the present invention.
Figure 9:
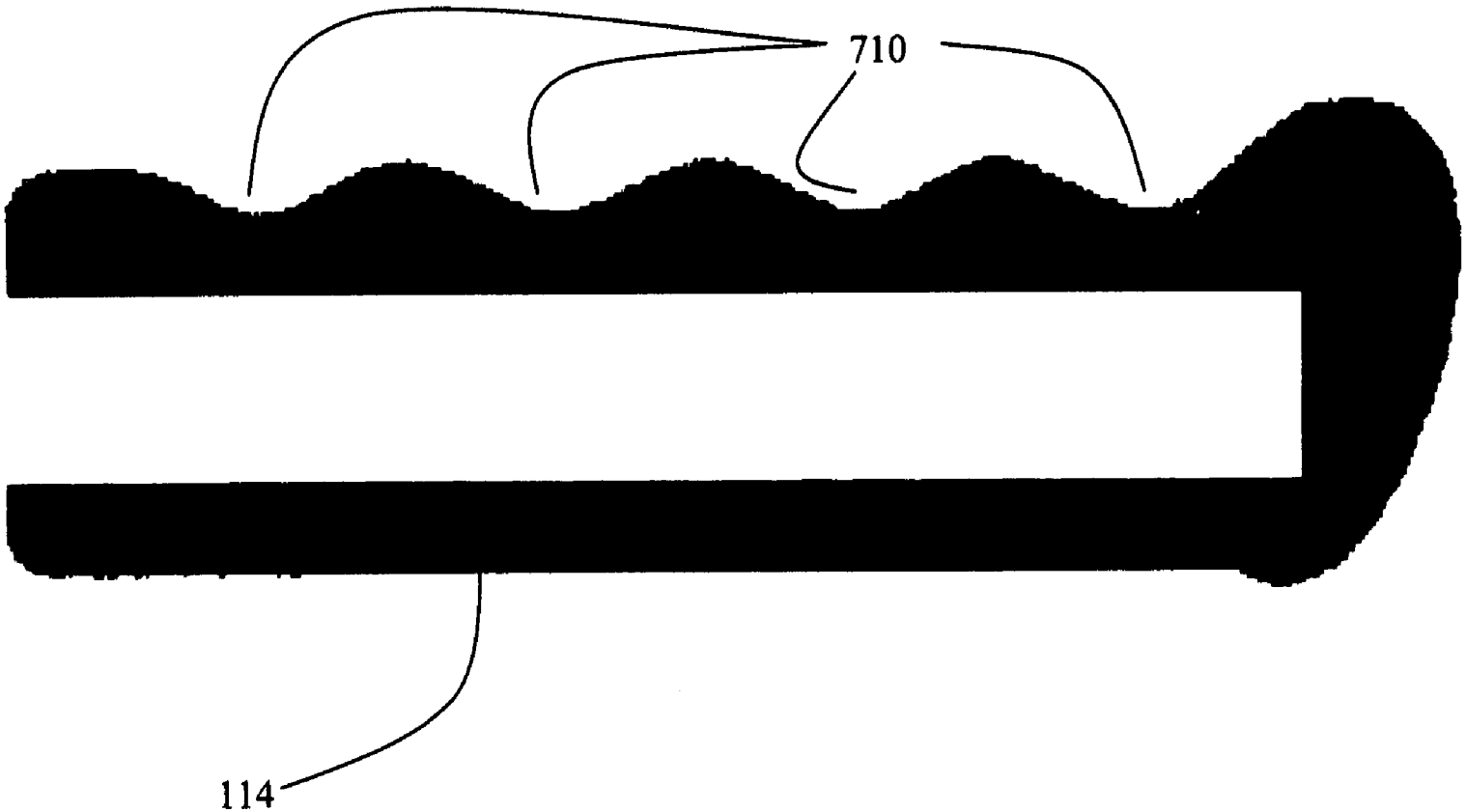
FIG. 9 illustrates a cross-sectional view of a grip of a preferred embodiment of the invention.

The grip 114 is placed over a portion of the housing adjacent the opening 132. In a preferred embodiment, the grip is approximately six inches in length, but other lengths of grips may be used with the invention. The grip 114 may take on any of a variety of shapes, but in a preferred embodiment, the grip is formed with a plurality of finger grip sections such as is shown in FIGS. 7 and 9. In FIG. 9, the grip 114 is shown as having an open end for receiving the housing and a closed end for covering the opposing end of the housing. It will be understood by those of ordinary skill in the art, that this is only one embodiment, and that in other embodiments, such as is shown in FIGS. 1 and 3, the grip is open on both ends and an end cap 132 is used to cover the end of the housing.

The housing may include a variety of openings in its sidewalls to accommodate various components of the system. One such opening may be for receiving one or more sensors 112 for a pulse monitor. The pulse monitor is placed in the grip portion of the housing in this particular embodiment. Thus, the grip 114 also would have an opening for the sensor (s) 112. Pulse monitors are generally known in the fitness field, and any suitable pulse monitor and sensor arrangement may be used with the invention. Alternatively, the primary handle may incorporate a receiver (not shown) for receiving data from a conventional pulse rate monitor such as one having sensors in a chest strap.

When the grip 114 is in place, a portion of the housing 110 extends out of the grip 114. That portion of the housing extending beyond the grip shall be referred to for reference purposes as the display/control portion 120 of the housing. While it is described here as a portion of the housing distinct from the grip portion, it will be under stood that the invention may be incorporated with a unitary structure, for example, such that the entire length of the housing is covered by the grip 114, but the grip 114 has one or more openings for receiving one or more displays and controls.

In the preferred embodiment shown in FIG. 1, the display/control portion 120 of the housing houses a battery compartment 128 for supplying power to the electronics in the primary handle. The electronics in the embodiment shown in FIG. 1 include a plurality of displays 126 for displaying information, such as estimated calories burned, exercise time, turn count, and heart rate. Other information such as time of day, average pulse, average turns per minute, or the like may be displayed in addition to or instead of this information. The displays may be arranged in any manner, but are shown in FIG. 1 as being part of a display/control panel.

At an end of the housing opposite the opening 102, there is a counting mechanism 140. The counting mechanism 140 is attached to a rope simulating element such as a rod or cord 150 having a weight 160 connected thereto. The counting mechanism 140 permits rotational movement of the rod or cord 150 around an axis 410 as shown in FIG. 4. The weight may be formed of a variety of materials, such as steel, rubber or plastic, but preferable is either formed from or covered with a flexible material for preventing injury in the even of an errant spin of the weight. The counting mechanism 140 also may permit movement in the direction 414. In an alternative embodiment, the counting mechanism 140 may be eliminated from the device such that the rope simulating element is attached to the handle housing.

The preferred embodiment likewise would include a plurality of control buttons 124 for controlling various functions of the electronics, such as power on/off, reset, and the like. Many different types of controls may be used with the invention.

Figure 6:
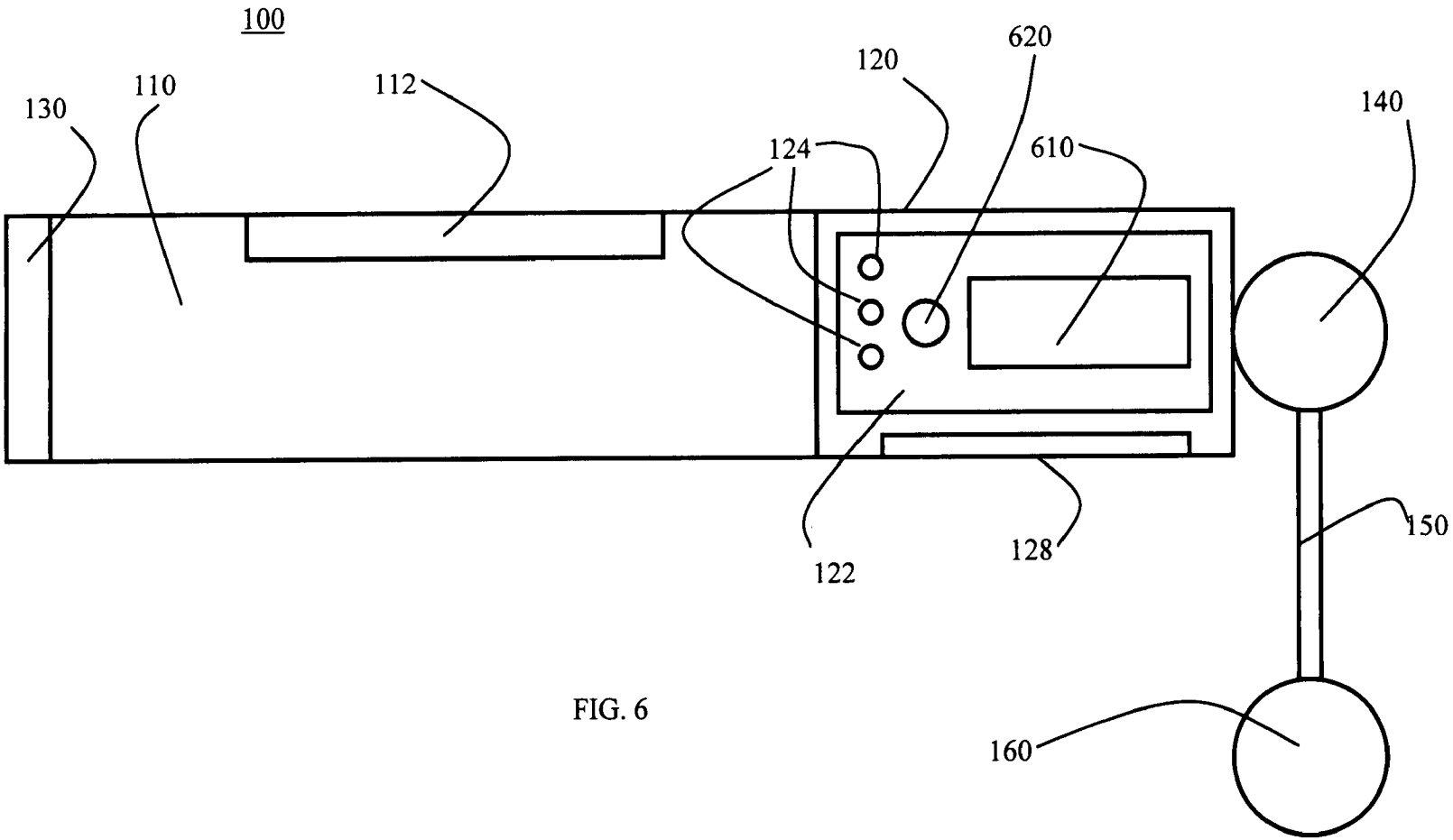
FIG. 6 illustrates a primary unit in accordance with an alternative embodiment of the invention.

In an alternative embodiment, as shown in FIG. 6, a single display 610 may be used for displaying all system information. With such a single display, various types of information may be cycled across the screen at preset or selected intervals. Alternatively, a display control 620 may be provided for permitting a user to select which information they would like to display.

An embodiment of a secondary or dumb handle 200 is shown in FIG. 2. The secondary handle has a housing 210 having a grip portion covered by a grip 214 (not shown) and a "dummy" portion 220. The end of the grip portion of the housing 210 has an opening 202 for receiving a weight 310 and an end cap 230 for retaining the weight within the housing. As with the primary handle, the inner side of the housing 210 adjacent the opening 202 may be threaded for mating with a threaded portion 232 of the end cap 230. The end caps 130 and 230 for the primary and secondary handles preferably are identical in size and structure and are interchangeable. Likewise, the primary and secondary housings 110, 210 preferably each have a chamber (not shown) within their hollow interiors for receiving a weight 310. A variety of weights 310 having different weights, such as ½, 1, and 1½ pounds, may be used, but preferably should be of similar size.

Figure 5:
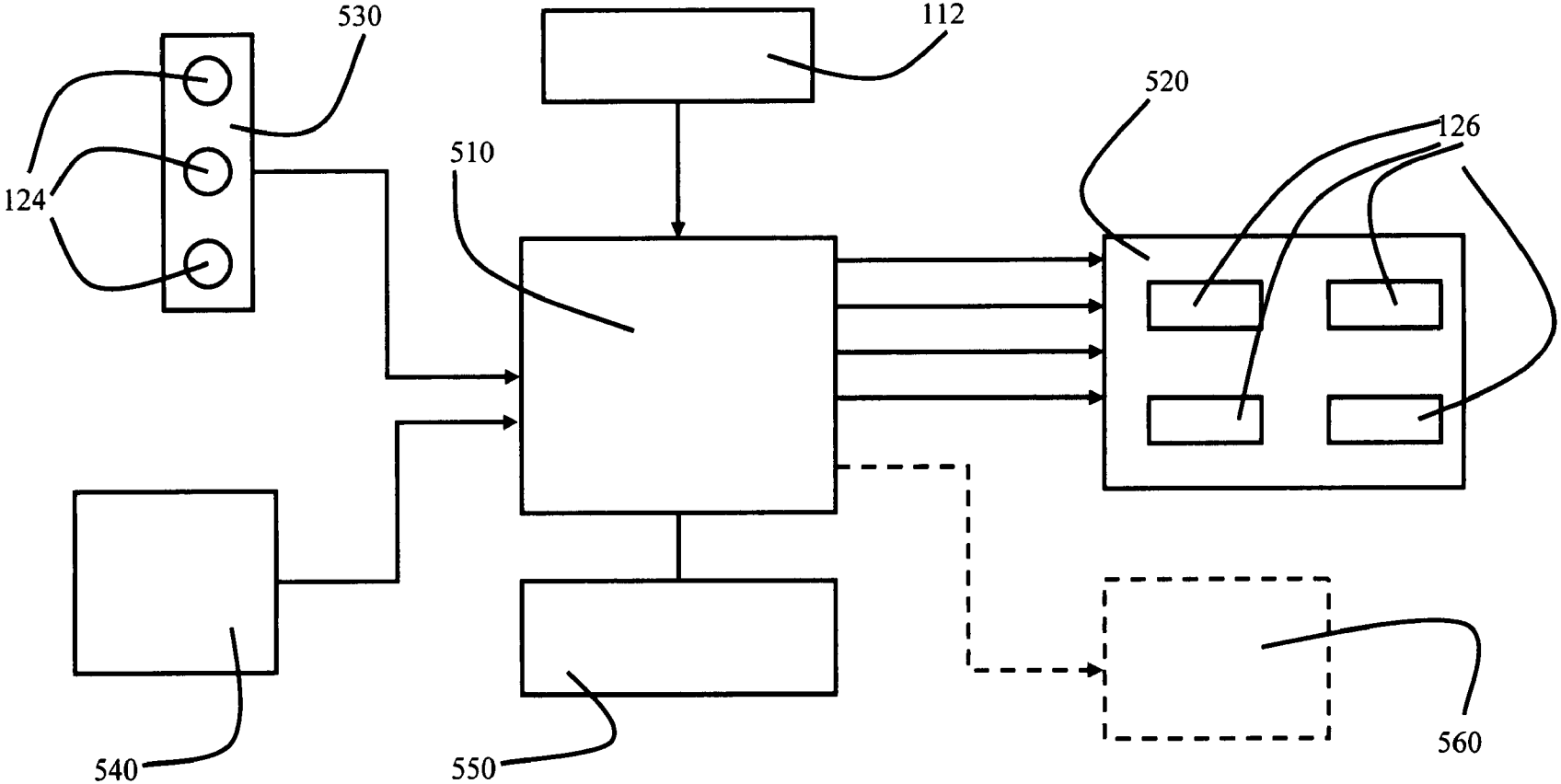
FIG. 5 illustrates the architecture of the electronics in a preferred embodiment of the invention.

A preferred embodiment of a system architecture for the electronics in the primary handle is shown in FIG. 5. A microprocessor 510 stores various data and processes within its internal memory (not shown) and is power by battery 550. The stored data may of any of a variety of types, may be simple or complex, and may be generic or specific to a user. For example, the data may be limited to the current workout or may include date and time information from a variety of past workouts or even a variety of users to provide users with records of their workouts or long periods of time. An alternative embodiment could include means, such as a USB, infrared or Ethernet port, for downloading or exporting information to a separate device such as a PC or a PDA. Such a means for exporting data further could be a port for receiving a memory device such as a flash memory, a memory stick, or the like. Such means also could be used for importing or uploading data, music, software or workout programs.

The microprocessor receives inputs from controls 530, counting mechanism 540 and heart monitor 112. The controls may be simple or complex depending on the particular embodiment. The controls may permit customization of a variety of factors, such as by permitting a user to enter identifying information and setting workout preferences such as desired heart rate ranges, workout time limits or intervals. The controls 530 may provide for a variety of inputs, such as on/off, reset, pulse range, turn pace and the like may be provided. Likewise, the controls may be used to set desired heart rate ranges, workout times, or workout intervals. The controls may come in any of a variety of forms from simple on/off and reset button controls to arrow keys, enter buttons and display menus.

Microprocessor 510 processes the various data received and outputs display data to display panel 520, which has one or more displays 126. The microprocessor may calculate and/or cause the display 520 to display a variety of information relating to the user including, but not limited to, turn count, turns per minute, average turns per minute, estimated total calories burned, estimate calories burned per time increment, time, running time, remaining workout time, heart rate, average heart rate, maximum heart rate, and minimum heart rate.

In an alternative embodiment, the system may have a speaker 560 or speakers for making various sounds such as a simulated click of a rope. The primary device has a mechanical device within the handle that counts each rotation of the metal rod on its axis in order to produce statistical analysis of the users exercise. The handle utilizes an internal computer device to record the number of rotations, calculate calories burned during use, and the time of use. The primary handle also generates a "snap" sound upon completion of each rotation in either direction. Beeps or other sounds may be used to denote particular time intervals such as one, five, or ten minute increments. Sounds likewise may be used to indicate, for example, that a minimum heart rate has been reached or a maximum heart rate has been exceeded. Additional sounds, such as a pace indicator likewise may be used. Such sounds emitting from the speaker may be as simple as beeps or may be more complex sounds such a music or voice recordings. Alternatively, a headphone jack may be used in place of an internal speaker.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A ropeless jump rope handle comprising:

a housing having first and second ends, said housing having a compartment for receiving a battery;

a rotatable counting mechanism connected to said second end of said housing;

a rope simulating element connected to said rotatable counting member;

means for inputting workout data;

a microprocessor for processing said inputted workout data;

a display; and means for generating a simulated click of a rope at the completion of each rotation of said rotatable counting mechanism.

2. A ropeless jump rope according to claim 1 further comprising means for controlling said display.

3. A ropeless jump rope according to claim 1 wherein said workout data comprises at least one of workout time, minimum heart rate, maximum heart rate and interval time.

4. A ropeless jump rope according to claim 1 wherein said display displays at least one of workout time, current user heart rate, average heart rate, and maximum heart rate.

5. A ropeless jump rope according to claim 1 wherein said first end of said housing has an opening for receiving a weight.

6. A ropeless jump rope according to claim 5 further comprising an end cap for retaining said weight within said housing.

7. A ropeless jump rope according to claim 1 further comprising a sensor mounted to said housing for sensing a user's heart rate and outputting heart rate data to said microprocessor.

8. A ropeless jump rope according to claim 1 further comprising a receiver for receiving heart rate data from a heart rate monitor and outputting heart rate data to said microprocessor.

9. A ropeless jump rope according to claim 1 wherein said rope simulating element comprises a rod having a weight attached to one end.

10. A ropeless jump rope according to claim 1 wherein said rope simulating element comprises a cord having a weight attached to one end.

11. A ropeless jump rope according to claim 1 further comprising means for generating a beeping sound distinguishable from said rope-clicking sound.

12. A ropeless jump rope according to claim 1 further comprising a means for exporting data.

13. A ropeless jump rope comprising:

a first handle comprising:

a first housing;

a grip;

a rotatable member;

a rope simulating element connected to said rotatable member;

a means for inputting workout data;

a microprocessor for processing said inputted workout data;

a display, said display receiving control data from said microprocessor; and means for generating a simulated click of a rope at the conclusion of each rotation of said rotatable member;

a battery; and a second handle comprising:

a second housing;

a grip; and a rope simulating element.

14. A ropeless jump rope according to claim 13 wherein at least a portion each of said first and second housings is hollow.

15. A ropeless jump rope according to claim 14 further comprising:

a first weight within said hollow portion said first housing; and a second weight within said hollow portion of said second housing.

16. A ropeless jump rope according to claim 15 wherein said first and second weights are interchangeable.

17. A ropeless jump rope according to claim 13 further comprising a heart rate monitor.

18. A ropeless jump rope according to claim 13 wherein said rope simulating element comprises a weighted rod.

19. A ropeless jump rope according to claim 13, said primary handle further comprising a counting mechanism for counting revolutions of said rope simulating element around an axis extending from a center of said primary handle.

* * * * *